US006505009B2

(12) United States Patent
Henricus et al.

(10) Patent No.: US 6,505,009 B2
(45) Date of Patent: Jan. 7, 2003

(54) WASTE TONER DETECTION SYSTEMS AND METHODS FOR DETERMINING THE VOLUME OF WASTE TONER IN A PRINTER CARTRIDGE

(75) Inventors: Joan L. Henricus, Boise, ID (US); Ryan H. Kolodziej, Nampa, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/875,378

(22) Filed: Jun. 5, 2001

(65) Prior Publication Data

US 2002/0181962 A1 Dec. 5, 2002

(51) Int. Cl.[7] ..... G03G 15/00; G03G 21/12
(52) U.S. Cl. ..... 399/35; 399/360
(58) Field of Search ..... 399/8, 34, 35, 399/358, 359, 360

(56) References Cited

U.S. PATENT DOCUMENTS

| | | | | | |
|---|---|---|---|---|---|
| 4,711,561 | A | * | 12/1987 | Tsuruoka | 399/35 |
| 4,745,440 | A | * | 5/1988 | Kono et al. | 399/35 X |
| 4,761,674 | A | * | 8/1988 | Ogura | 399/35 |
| 4,868,599 | A | * | 9/1989 | Niki | 399/35 |
| 5,500,716 | A | * | 3/1996 | Morishita et al. | 399/35 |
| 5,594,529 | A | * | 1/1997 | Yamashita et al. | 399/8 |
| 5,873,009 | A | * | 2/1999 | Yamashita et al. | 399/8 |

* cited by examiner

*Primary Examiner*—William J. Royer

(57) ABSTRACT

System and methods for sensing a condition of a printer cartridge waste volume. In one embodiment the system provides notification when a printer cartridge needs to be replaced. The system includes a printer, a printer cartridge for the printer having a waste volume, and a sensor operably coupled with the printer cartridge for sensing the waste volume in the printer cartridge.

3 Claims, 6 Drawing Sheets

WASTE TONER DETECTION SYSTEMS AND METHODS FOR DETERMINING THE VOLUME OF WASTE TONER IN A PRINTER CARTRIDGE

TECHNICAL FIELD

This invention pertains to printers and printer systems, and, more particularly, to methods and systems for managing printer byproducts.

BACKGROUND

Printing devices typically use consumable items that must be replaced. In recent years a great amount of work has been done to increase the efficiency of consumable management. Managing consumables effectively can greatly increase the efficiency with which both the consumable and its associated device are used. As an example of some consumables management solutions, the reader is referred to the following U.S. Patents, all of which are incorporated by reference herein: U.S. Pat. Nos. 6,154,619, 6,128,448, 6,102,508, 6,019,449, 5,987,269, 5,930,553, 5,812,156, 5,758,224, 5,729,277, and 5,682,140.

There are different types of consumable items. For example, toner is a consumable that is typically used in printers to effect printing on a print media such as paper Toner typically comes in a toner or printer cartridge with a defined amount of toner. When the toner is depleted it must be replaced for printing to continue. The large amount of work done in this area has delivered great returns. Now, monitoring how much toner remains in a printer cartridge so that the user will know when the toner cartridge needs to be replaced is done very efficiently. This has lead to greater printer efficiency and less down time.

During printing, toner is removed from the toner supply and transferred to an intermediary device before being transferred to a sheet of paper. Commonly, the intermediary device is a rotating drum. Various techniques are used for properly positioning toner on the drum for transfer to the paper. However, for various reasons, some toner is not transferred to the paper and remains on the drum. This used or waste toner must be removed before the drum revolves around to pick up the toner for the next page or unwanted printing can occur. This task is often accomplished with a cleaning blade which wipes any remaining toner off of the drum.

The toner or printer cartridge generally has a volume dedicated to the storage of the waste toner. Under some circumstances, however, the amount of used or waste toner can exceed this volume. In these circumstances, the waste toner may overflow the cartridge and fall or drip onto pages as they are printed. In this case, existing printers do not detect anything wrong. Yet, the user, seeing misplaced toner on the page, assumes the printer to be malfunctioning and typically calls for a repairman to come fix the printer. This is very expensive and time consuming and causes decreased user confidence in the printer as well as undesirable downtime. Thus, the great strides made in monitoring consumables have now reached a level where a problematic area is not so much monitoring consumables before they are used, but dealing with the byproducts of consumables such as toner.

Accordingly, this invention arose out of concerns associated with providing improved systems and methods for managing printer byproducts.

SUMMARY

Waste toner monitoring systems and methods are described. In one embodiment, a novel printer cartridge construction is provided. The printer cartridge comprises a housing, a cavity within the housing for holding used toner, and a sensor positioned to detect a condition associated with the cavity becoming full.

In another embodiment, a system is provided for providing a notification when a printer cartridge needs to be replaced. The system comprises a printer, a printer cartridge for the printer having a waste volume, and a sensor operably coupled with the printer cartridge for sensing the waste volume in the printer cartridge. When toner in the waste volume reaches a predetermined level, a notification can be generated which can help ensure that an overflow situation does not occur.

BRIEF DESCRIPTION OF THE DRAWINGS

The same numbers are used throughout the drawings to reference like features and components.

DETAILED DESCRIPTION

Overview

The inventive techniques and systems described below permit printers or printer cartridges to sense when the volume of waste toner exceeds a definable amount. Notification can then be provided so that the printer cartridge can be changed before an overflow condition occurs.

Exemplary Printer System

Figure 1:
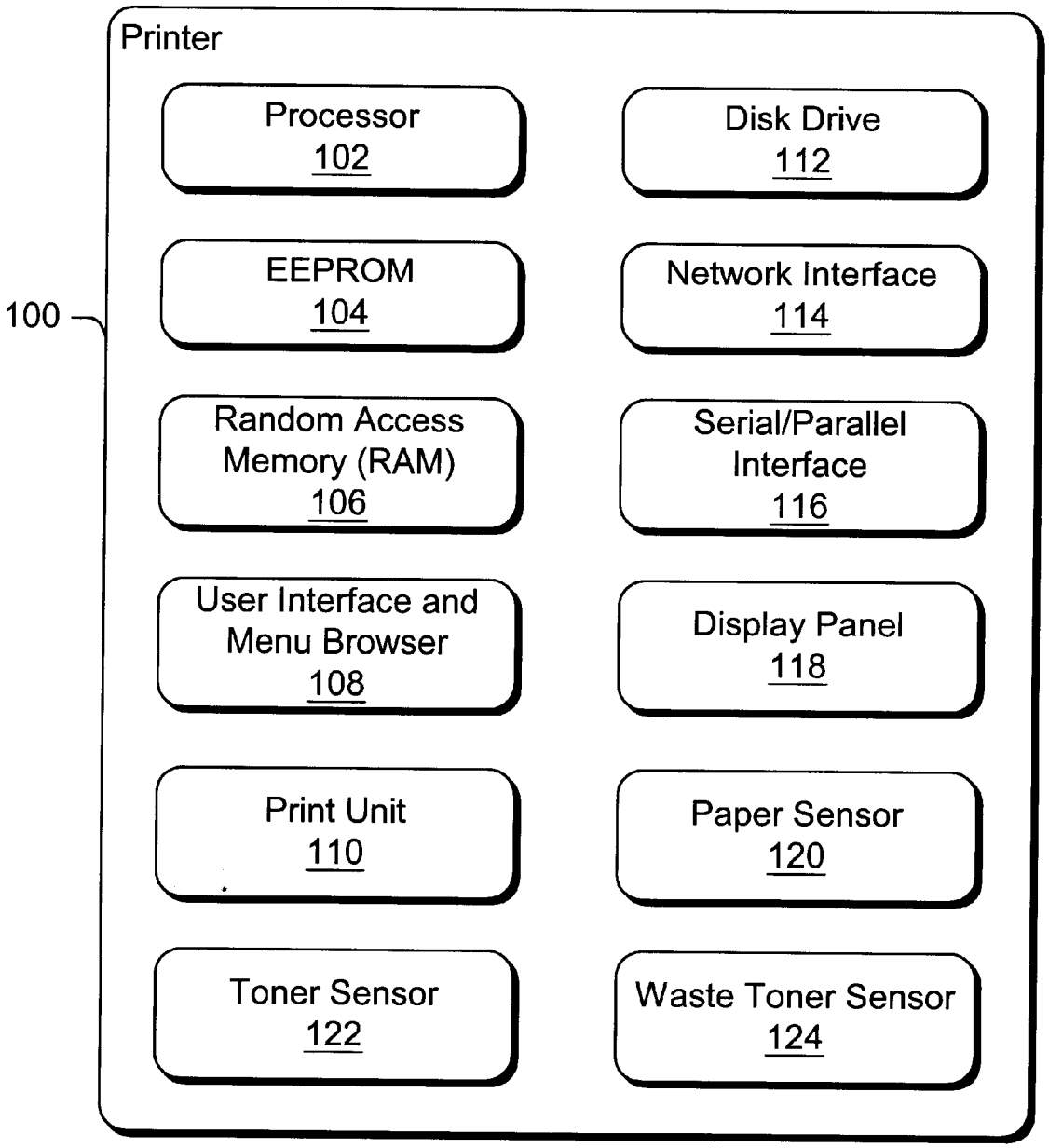
FIG. 1 is a block diagram of an exemplary printer in accordance with one embodiment.

For purposes of understanding various structures associated with an exemplary printing device, consider FIG. 1.

FIG. 1 is a block diagram showing exemplary components of a printing device in the form of a printer 100 in accordance with one embodiment. It will be appreciated and understood that the illustrated printing device constitutes but one exemplary printing device and is not intended to be limiting in any way. Accordingly, other printing devices can be used in connection with the inventive techniques and systems described herein. These other printing devices can have components that are different from those described immediately below.

Printer 100 includes a processor 102, an electrically erasable programmable read-only memory (EEPROM) 104, and a random access memory (RAM) 106. Processor 102 processes various instructions necessary to operate the printer 100 and communicate with other devices. EEPROM 104 and RAM 106 store various information such as configuration information, fonts, templates, data being printed, and menu structure information. Although not shown in FIG. 1, a particular printer may also contain a ROM (non-erasable) in place of or in addition to EEPROM 104. Furthermore, a printer may alternatively contain a flash memory device in place of or in addition to EEPROM 104.

Printer 100 can also include a disk drive 112, a network interface 114, and a serial/parallel interface 116. Disk drive 112 provides additional storage for data being printed or other information used by the printer 100. Although both RAM 106 and disk drive 112 are illustrated in FIG. 1, a particular printer can contain either RAM 106 or disk drive 112, depending on the storage needs of the printer. For example, an inexpensive printer may contain a small amount of RAM 106 and no disk drive 112, thereby reducing the manufacturing cost of the printer. Network interface 114 provides a connection between printer 100 and a data communication network. Network interface 114 allows devices coupled to a common data communication network to send print jobs, menu data, and other information to printer 100 via the network. Similarly, serial/parallel interface 116 provides a data communication path directly between printer 100 and another device, such as a workstation, server, or other computing device. Although the printer 100 shown in FIG. 1 has two interfaces (network interface 114 and serial/parallel interface 116), a particular printer may only contain one interface.

Printer 100 also includes a print unit 110 that includes mechanisms that are arranged to selectively apply ink (e.g., liquid ink, toner) to a print media (e.g., paper, plastic, fabric) in accordance with print data within a print job. Thus, for example, print unit 110 can include a conventional laser printing mechanism that selectively causes toner to be applied to an intermediate surface of a drum or belt. The intermediate surface can then be brought within close proximity of a print media in a manner that causes the toner to be transferred to the print media in a controlled fashion. The toner on the print media can then be more permanently fixed to the print media, for example, by selectively applying thermal energy to the toner. Print unit 110 can also be configured to support duplex printing, for example, by selectively flipping or turning the print media as required to print on both sides. Those skilled in the art will recognize that there are many different types of print units available, and that for the purposes of the present embodiments print unit 110 can include any of these various types.

Printer 100 also contains a user interface/menu browser 108 and a display panel 118. User interface/menu browser 108 allows the user of the printer to navigate the printer's menu structure. User interface/menu browser 108 may be a series of buttons, switches or other indicators that are manipulated by the user of the printer. The printer display or display panel 118 is a graphical display that provides information regarding the status of the printer and the current options available through the menu structure.

Printer 100 also includes a paper sensor 120, a toner sensor 122, and a waste toner sensor 124. The paper sensor 120 has characteristics that permit it to ascertain a measure that is associated with an amount of print media that remains in the printer 100. The toner sensor 122 can be any of the various types which are known in the art. Some of these can be units contained in the printer cartridge, while others can be a component of the printer which senses a condition of the toner volume within the printer cartridge. The waste toner sensor 124, as with the toner sensor, can be a sensor contained in the printer cartridge, or can be a component of the printer which senses a condition of the toner waste volume in the printer cartridge. In the present embodiments, unused toner is referred to as "toner," and is measured as "toner volume", while the byproduct waste or used toner which has been applied to an intermediary surface but was not transferred to a print medium (usually paper) is referred to as "waste toner," "used toner," or simply "waste." This toner is measured as "waste toner volume," and is stored in a "waste toner hopper" or "waste toner cavity."

In the discussion above and below, certain aspects of the described embodiments can be implemented in terms of software instructions that reside on a computer-readable media. These instructions, when executed by a computer or processor, are configured to implemented a designed functionality. This functionality will be described in this document in flow chart form.

Exemplary Host Computer

Figure 2:
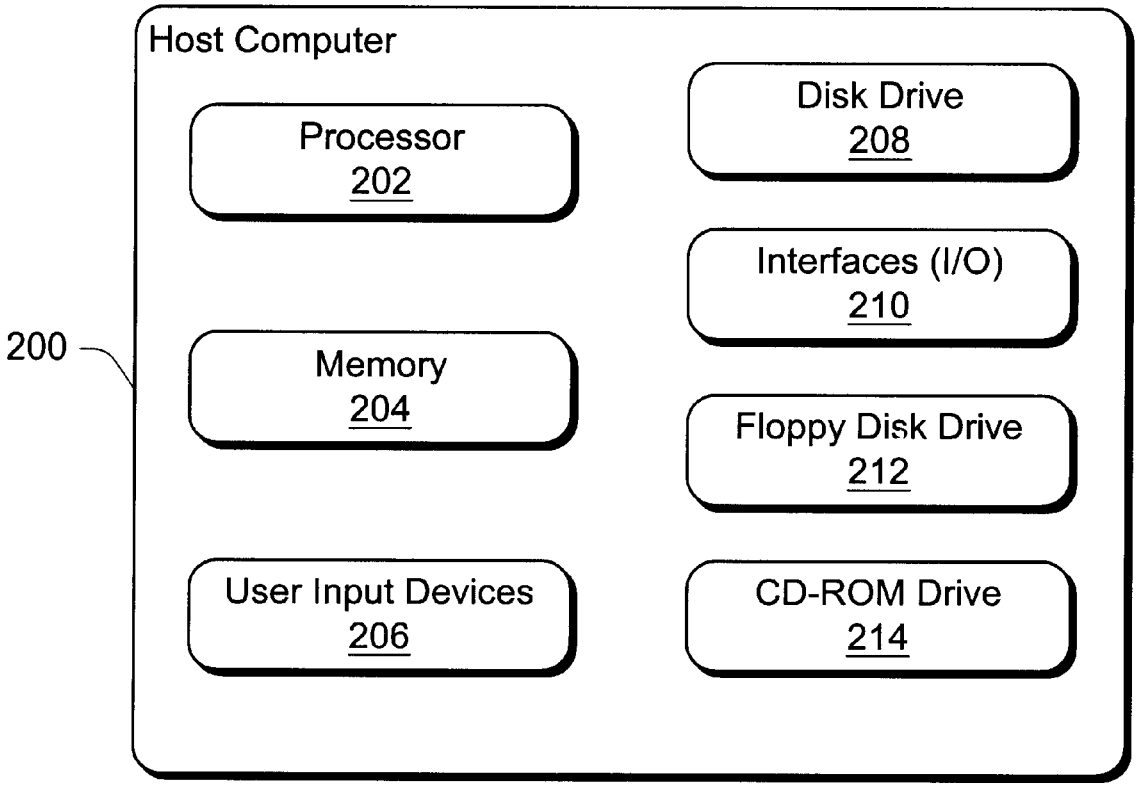
FIG. 2 is a block diagram of a n exemplary host computer in accordance with one embodiment.

For purposes of understanding various structures associated with an exemplary host computer, consider FIG. 2.

FIG. 2 is a block diagram showing exemplary components of a host computer 200. Host computer 200 includes a processor 202, a memory 204 (such as ROM and RAM), user input devices 206, a disk drive 208, interfaces 210 for inputting and outputting data, a floppy disk drive 212, and a CD-ROM drive 214. Processor 202 performs various instructions to control the operation of computer 200. Memory 204, disk drive 208, and floppy disk drive 212, and CD-ROM drive 214 provide data storage mechanisms. User input devices 206 include a keyboard, mouse, pointing device, or other mechanism for inputting information to computer 200. Interfaces 210 provide a mechanism for computer 200 to communicate with other devices.

Exemplary Embodiment

Figure 3:
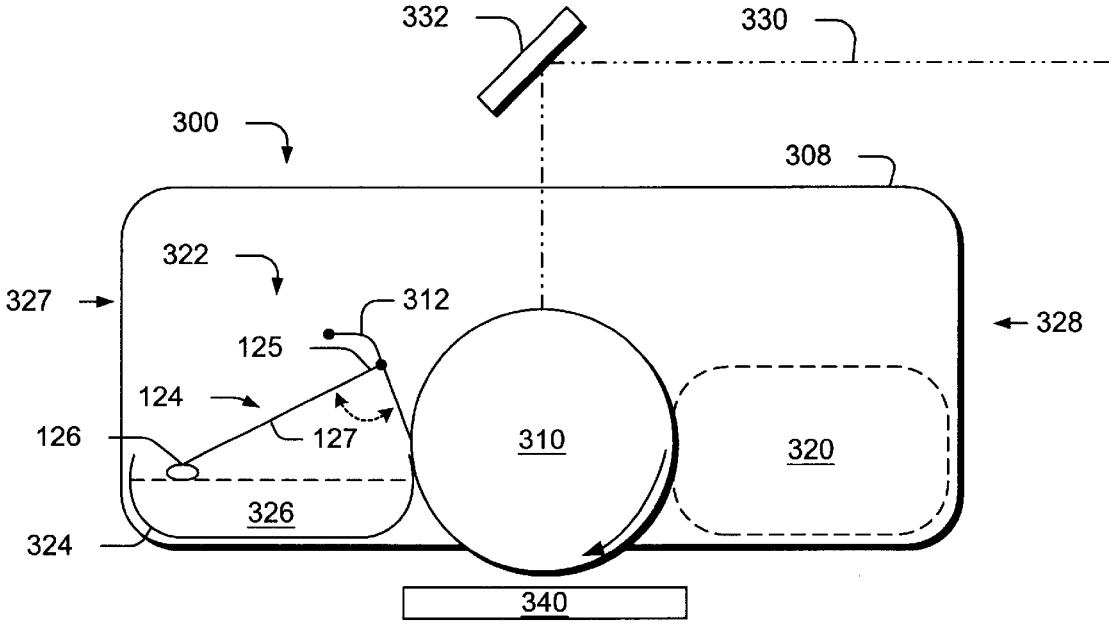
FIG. 3 is a side sectional diagram of an exemplary printer cartridge in accordance with one embodiment.
Figure 3A:
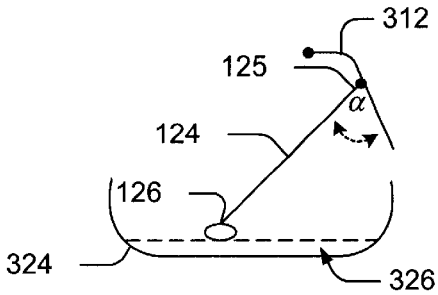
FIG. 3*a* is a side sectional view of a portion of the FIG. 3 printer cartridge in accordance with one embodiment.
Figure 3B:
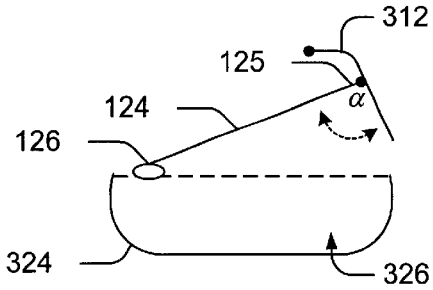
FIG. 3*b* is a side sectional view of a portion of the FIG. 3 printer cartridge in accordance with one embodiment.
Figure 4:
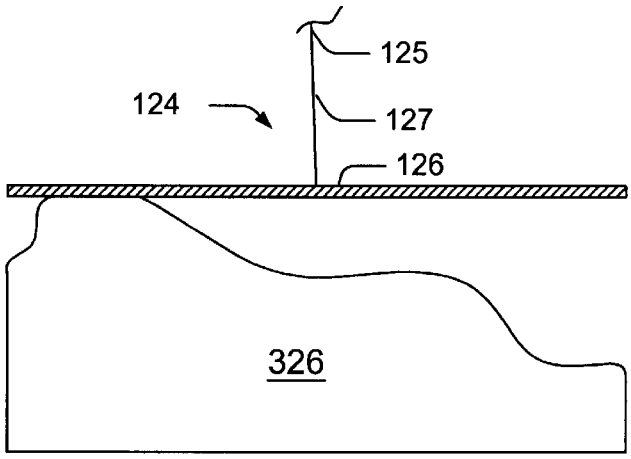
FIG. 4 is a front plan view of an exemplary waste toner sensor in accordance with one embodiment.
Figure 4A:
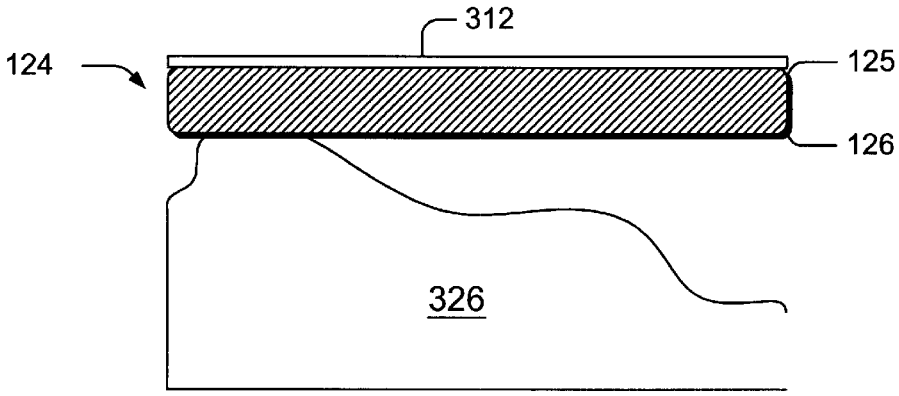
FIG. 4*a* is a front plan view of an exemplary waste toner sensor in accordance with one embodiment.

FIG. 3 shows generally a cross section of an exemplary printer cartridge 300 in accordance with one embodiment. FIGS. 3*a* and 3*b* further illustrate aspects of the FIG. 3 waste toner sensor. FIGS. 4 and 4*a* show alternate embodiments of a waster toner sensor. The various components described below may not be illustrated accurately as far as their size is concerned. Rather, FIGS. 3 and 4 are intended as diagrammatic representations to illustrate to the reader various inventive principles that are described herein.

In this non-limiting embodiment, the print unit 110 can comprise the printer cartridge 300. For purposes of the explanation that follows, assume that the printer cartridge contains the waste toner sensor 124.

The printer cartridge 300 comprises a housing 308, a photosensitive drum 310, a cleaning blade 312, a toner volume 320, and a waste toner cavity 322. A waste toner hopper 324 is disposed in the waste toner cavity and can define a waste toner volume 326. The printer cartridge 300 also has a front surface generally shown as 327 and an opposite back surface 328.

The waste toner cavity 322 can comprise any volume of the printer cartridge 300 where waste toner can be stored. In one embodiment the waste toner can be stored in the waste toner hopper 324, and thus, the measured waste toner volume 326 can be measured in the waste toner hopper 324.

The printer cartridge also interfaces with a laser beam 330, a mirror 332, and a transfer region 340. The laser beam 330 can be reflected onto the photosensitive drum 330 by the mirror 332. The laser beam 330 can cause variations in the charge on the surface of the photosensitive drum 310 which causes some surface areas to attract toner. As the photosensitive drum 310 revolves, the toner can be transferred to the print medium (usually paper) in the transfer region 340. Any toner remaining on the photosensitive drum 310 after the transfer region 340 can be removed by the cleaning blade 312. This waste toner can comprise the waste toner volume 326.

In one non-limiting embodiment, the waste toner sensor 124 has a fixed or mounted end 125 about which an opposite free end 126 can rotate. In the illustrated embodiment, the fixed end 125 of the waste toner sensor 124 can be supported by the cleaning blade 312 for movement in accordance with a level of waste toner in the waste toner hopper 324. In some embodiments, the two ends (125 and 126) can be connected via an arm portion 127. FIG. 3 further shows that the free end 126 of the waste toner sensor 124 can be constructed in a manner which allows it to float on the waste toner contained in the waste toner cavity 322. To this extent, the free end 126 can include a float (not specifically designated).

In some embodiments, the waste toner sensor 124 can have a portion having an essentially planar construction which extends along a majority of the length of the printer cartridge 300 (i.e. into and out of the plane of the page upon which FIG. 3 appears). FIGS. 4 and 4*a* illustrate how this planar construction can allow the waste toner sensor 124 to detect certain regions where the waste toner has built up to a higher level than other regions. This condition can be caused by the type of printing for which the printer is used. For example, a printer can be used predominately for print jobs such as envelopes which are not as wide as a normal page. In this case, waste toner can build up unevenly in one region of the printer cartridge 300 and begin to overflow while other regions are below capacity. In this embodiment, the sensor 124 can be constructed to sense the highest levels of waste toner within the printer cartridge 300.

As shown in FIG. 4 the waste toner sensor 124 has a generally planar construction and extends essentially the length of the printer cartridge 300. Free end 126 can comprise a float connected via arm portion 127 to the fixed end 125. Although not shown, the fixed end 125 can be attached to any suitable structure such as housing 308.

FIG. 4*a* shows an alternate construction of the waste toner sensor 124 which, in this example, is made from a material such as Mylar or plastic. The fixed end 125 can be attached to any appropriate structure. For example, cleaning blade 312 can be used as shown here. The free end 126 floats on, or is otherwise supported by the waste toner volume 326.

The construction of the waste toner sensor 124 as depicted in FIG. 3, can provide several ways of sensing the volume of waste toner. For example, the angle of the waste toner sensor 124 relative to some reference point can be determined at varying degrees of fullness. One non-limiting embodiment of how this can be achieved is shown in FIGS. 3*a* and 3*b*.

FIG. 3*a* shows the waste toner volume 326 in the waste toner hopper 324 to be very low. In this case, note that the angle $\alpha$ between the cleaning blade 312 and the waste toner sensor 124 is quite small, approximately 60 degrees. In FIG. 3*b*, the waste toner volume has increased and as a result the waste toner sensor 124 has changed position. Note the angle a is now much larger, approximately 100 degrees. The sensed angles can be compared to known predetermined values to determine the fullness of the waste toner cavity 322. The waste toner sensor 124 has been described in this non-limiting embodiment as having a free or floating end 126 and a fixed end 125. However, many other embodiments are also possible. For example, the waste hopper sensor can comprise an essentially vertical fixed element positioned in the waste toner cavity 322. A floating element can travel along the fixed element as the floating element is displaced by the waste toner.

Figure 4B:
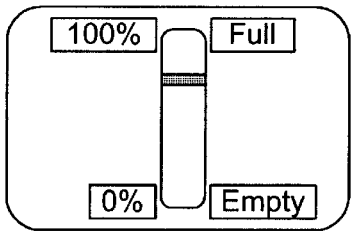
FIG. 4*b* is a front plan view of an exemplary waste toner sensor comprising a visual display in accordance with one embodiment .

In various embodiments, the printer's display panel 118 can be functionally coupled to the waste toner sensor 124 and display a waste toner volume status. For example, the waste toner sensor 124 can be electrically coupled to the printer 100 to generate a signal as the waste toner sensor 124 reaches various angles or positions. The signal can be displayed on display panel 118. FIG. 4*b* shows one possible embodiment of a display. The display in FIG. 4*b* shows a waste toner volume that is generally more than half full, but is still below 100 percent of capacity. In another embodiment, the display on the display panel can read "waste toner hopper full" or alternatively, "replace toner cartridge." These messages can be displayed when the waste volume reaches a predetermined value.

Further, the waste toner sensor 124 can be functionally coupled to the network interface 114 or the serial/parallel interface 116. This can allow a notification to be generated, sent, and displayed on a computer or other device coupled to the printer 100 either directly or through a network. Thus, a signal generated by the sensor 124 can provide a user notification on various devices. This can help to ensure the user notification is actually perceived by a user or administrator.

Alternatively, for printers lacking a display panel 118 and/or other components, the display depicted in FIG. 4*b* can be placed on the outside of a printer cartridge 300 in manner which allows a condition of waste toner sensor 124 to be visible on the outside of the printer cartridge 300. In still another embodiment, the display depicted in FIG. 4*b* can be on the outside of the printer 100 so that a condition of the waste toner sensor 124 can be visible on the outside of the printer 100.

In still another embodiment, the waste toner sensor 124 can be operably coupled with the printer cartridge 300 for sensing the waste toner volume 326 in the printer cartridge 300. The art of sensor technology is expansive and one skilled in the art will recognize many embodiments which can sense a waste toner volume.

Exemplary First Method

Figure 5:
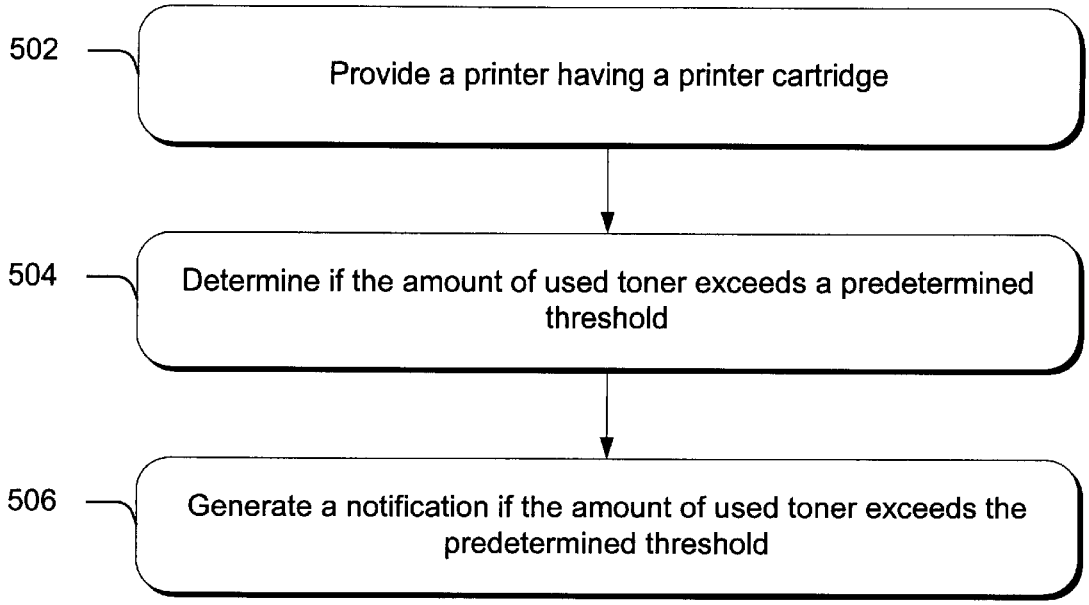
FIG. 5 is a flow diagram describing steps in a method in accordance with one embodiment.

FIG. 5 is a flow diagram that describes steps in a method in accordance with one embodiment. The steps can be implemented in any suitable hardware, software, firmware, or combination thereof. Certain steps described below can be implemented using a waste toner sensor such as those described above.

Step 502 provides a printer that has a printer cartridge. The printer can be configured for operation within a network. Step 504 determines whether an amount of used toner in the printer cartridge exceeds a predetermined threshold. This step can be achieved using a variety of used toner sensors.

A predetermined threshold can be any value of which it is desirable to be aware. For example, some users may want to know the volume of the waste in the waste toner hopper at various stages. Other users may be interested only when the waste toner hopper is full.

Step 506 generates a notification if the amount of used toner exceeds the predetermined threshold. The notification can be generated by the sensor itself, by the printer, or some other device coupled to the printer. Further, the notification can comprise any form which can be useful in the operation of a printer. Several exemplary notifications have been described including, without limitation, a visual notification on the printer display panel as described in FIG. 1, and a notification on a computer which is coupled directly to the printer or indirectly through a network. Other exemplary notifications can include an audio notification or a notification which causes the printer to shut down until the printer cartridge is replaced.

Exemplary Second Method

Figure 6:
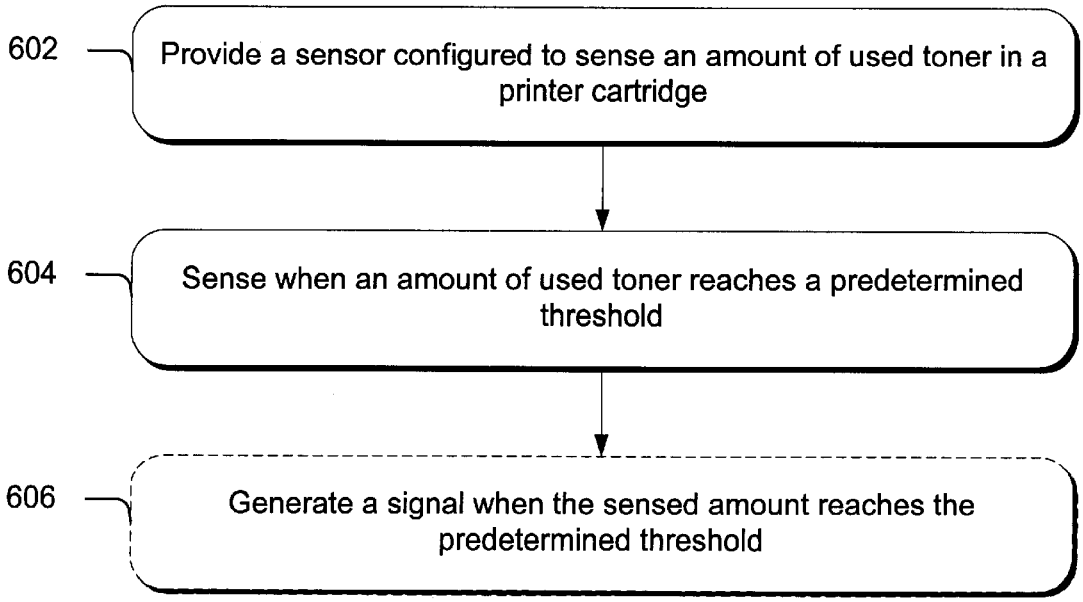
FIG. 6 is a flow diagram describing steps in a method in accordance with one embodiment.

FIG. 6 is a flow diagram that describes steps in a method in accordance with another embodiment.

Step 602 provides a sensor configured to sense an amount of used toner in a printer cartridge. Non-limiting examples of sensors are described above.

Step 604 senses, with the sensor, when an amount of used or waste toner reaches a predetermined threshold. The predetermined threshold can be any value which is desirable to know. It can be determined by a printer user or printer maintenance person, or it can be established by the printer manufacturer and/or printer cartridge manufacturer.

Step 606 generates a signal when the sensed amount of used toner reaches the predetermined threshold. This signal can be any signal which provides notification to a printer user or person in charge of printer maintenance. The notice can be provided on the printer or on a device coupled with the printer.

Exemplary Third Method

Figure 7:
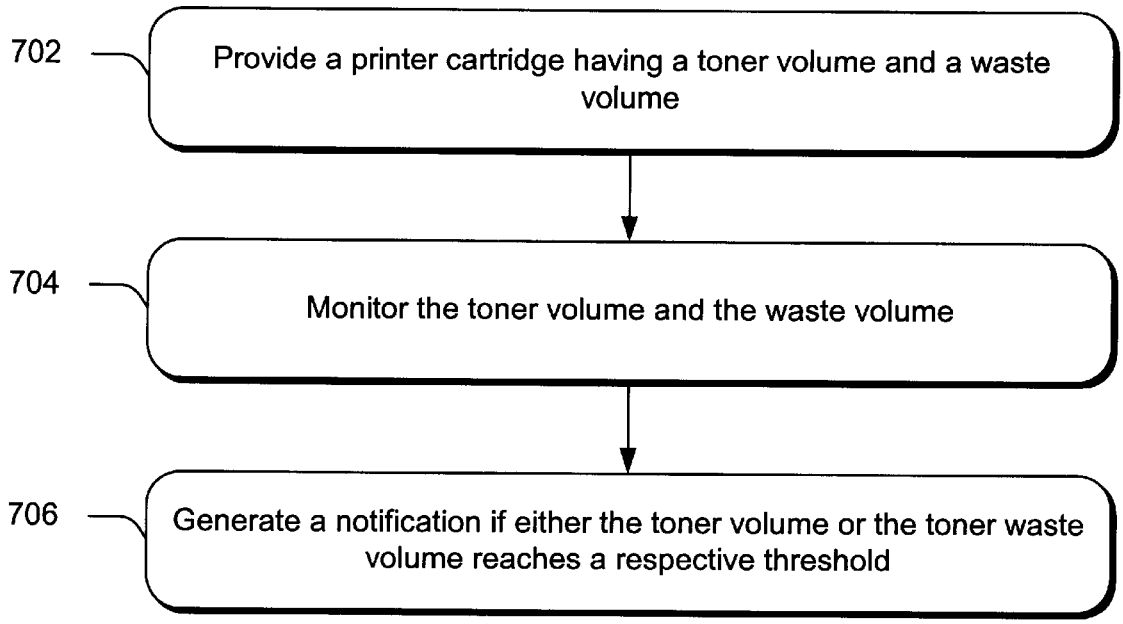
FIG. 7 is a flow diagram describing steps in a method in accordance with one embodiment.

FIG. 7 is a flow diagram that describes steps in a method in accordance with one described embodiment.

Step 702 provides a printer cartridge having a toner volume and a waste volume. As described above many types of printer cartridges can satisfy this step. Non-limiting examples are given above.

Step 704 monitors the toner volume and the waste volume. One skilled in the art will recognize many ways to monitor the toner volume. Several different ways of monitoring the waste volume have been discussed above.

Step 706 generates a notification if either the toner volume or the waste volume reaches a respective definable threshold. The definable threshold for the toner volume can be any volume which can be desirable to know. For example, a user may want to know when only ten percent of the toner volume remains so that the printer cartridge can be replaced at a time convenient for the user and not in the middle of a subsequent print job when the toner runs out. A network administrator may want to receive a notification when only 25 percent of the toner remains so that maintenance can be scheduled.

The definable threshold for the printer cartridge waste volume also can be any value which can be desirable to know. Of course the waste volume can become more useful to know as it gets higher, whereas the toner volume can be more important as it gets lower. For example, the printer user may want notification when the waste volume has reached 90 percent of capacity, or when 10 percent of the toner remains. The manufacturer of the printer cartridge and/or the printer manufacturer can also recommend respective volumes at which a notification can be generated.

Monitoring both of these conditions can increase the efficiency of printer usage. For example, a busy printer user often is not interested in details about what condition is causing a printer cartridge to need to be replaced. They just want the printer to work properly. In one embodiment a notice can be displayed that the printer cartridge needs to be replaced if either the toner volume or the toner waste volume reaches a respective definable threshold. Up to now, the printer user may have only received a notice if the printer cartridge was low on toner. Yet, the printer can malfunction because of too much waste in the printer cartridge. Now the cartridge can be changed if either condition exists, thus increasing printer reliability.

The above monitoring and notification can allow greater productivity by increasing the percentage of time that a printer is functioning properly. In the past, only unused toner volume has been monitored. This has led to a condition where used toner exceeding the printer cartridge capacity can be the weakest link in ensuring proper printer functioning.

Conclusion

Systems and methods for sensing the volume of waste toner in a printer cartridge have been described. Notification can be provided to a printer user or administrator when the volume of waste reaches a definable volume. Sensing the toner waste volume and providing a notification can lead to increased printer efficiency and user convenience. The sensing of the toner waste volume can be done in combination with sensing the toner volume so that a notification can be generated that the printer cartridge needs to be replaced when either toner volume becomes low or the waste volume becomes high.

The systems and methods described allow for greater printer user satisfaction since undesirable conditions resulting from too much waste toner volume can be avoided.

Although the invention has been described in language specific to structural features and/or methodological steps, it is understood that the invention defined in the appended claims is not necessarily limited to the specific features or steps described. Rather, the specific features and steps are disclosed as preferred forms of implementing the claimed invention.

What is claimed is:

1. A printer cartridge comprising:

a housing;

a cavity within the housing for holding waste toner; and, a sensor positioned to detect a condition associated with the cavity becoming full, wherein the sensor comprises an arm and a float attached to the arm, the float being positioned to engage and be moved by the waste toner.

2. A printer cartridge comprising:

a housing;

a cavity within the housing for holding waste toner;

a sensor positioned to detect a condition associated with the cavity becoming full, the sensor comprising an arm having a mounted end and a free end, the mounted end being pivotally mounted relative to the printer cartridge to accommodate movement of the free end in relation to an amount of waste toner that is disposed in the cavity; and, a float attached to the free end and positioned to engage a volume of waste toner in a manner that moves the free end.

3. A printer cartridge comprising:

a housing;

a cavity within the housing for holding waste toner;

a sensor positioned to detect a condition associated with the cavity becoming full, the sensor comprising an arm having a mounted end and a free end, the mounted end being pivotally mounted relative to the printer cartridge to accommodate movement of the free end in relation to an amount of waste toner that is disposed in the cavity; and, a generally planar structure joined with the free end, said structure being configured to extend within the cavity so as to engage portions of waste toner that might be unevenly distributed in the cavity.

* * * * *